US005882247A

United States Patent [19]

Longuet et al.

[11] Patent Number: 5,882,247

[45] Date of Patent: Mar. 16, 1999

[54] MACHINE FOR GRINDING OF OPTICAL GLASSES

[75] Inventors: Raynald Marcel Gaston Longuet, La Campagne; Jean-Jacques Bernard Joseph Videcoq, Pavilly, both of France

[73] Assignee: Briot International, Pont de L'Arche, France

[21] Appl. No.: 886,970

[22] Filed: Jul. 2, 1997

[30] Foreign Application Priority Data

Jul. 22, 1996 [FR] France ..... 96 09171
May 20, 1997 [FR] France ..... 97 06126

[51] Int. Cl.[6] ..... B24B 7/00; B24B 9/00

[52] U.S. Cl. ..... 451/236; 451/5; 451/65; 451/57

[58] Field of Search ..... 451/5, 9, 10, 28, 451/41, 42, 43, 44, 57, 58, 65, 177, 240, 255, 256, 913, 236, 237, 294

[56] References Cited

U.S. PATENT DOCUMENTS

| | | | |
|---|---|---|---|
| 3,919,811 | 11/1975 | Hedelin | 451/42 |
| 4,179,851 | 12/1979 | Neisler et al. | 451/43 |
| 4,870,784 | 10/1989 | Ramos et al. | 451/42 |
| 5,053,971 | 10/1991 | Wood et al. | 451/43 |
| 5,056,270 | 10/1991 | Curcher | 451/43 |
| 5,161,333 | 11/1992 | Lecerf et al. | 451/43 |
| 5,630,746 | 5/1997 | Gottschald et al. | 451/43 |
| 5,643,052 | 7/1997 | Delattre et al. | 451/43 |
| 5,727,987 | 3/1998 | Gottschlad | 451/43 |

FOREIGN PATENT DOCUMENTS

| | | | |
|---|---|---|---|
| 350 216 | 6/1989 | European Pat. Off. . | |
| 350216 | 1/1990 | European Pat. Off. | 451/42 |
| 589 628 | 9/1993 | European Pat. Off. . | |
| 2 499 442 | 8/1982 | France . | |
| 2 689 794 | 4/1993 | France . | |
| 42 14596 | 11/1993 | Germany . | |
| 96/09914 | 4/1996 | WIPO . | |

*Primary Examiner*—David A. Scherbel
*Assistant Examiner*—Derris H. Banks
*Attorney, Agent, or Firm*—Wenderoth, Lind & Ponack, L.L.P.

[57] ABSTRACT

This machine comprises a train of grinding wheels (T) which is keyed on a shaft (2), and a blank-holding assembly (5, 7) designed to bring the blank (8) into contact with the grinding wheels. The said machine comprises, furthermore, an additional grinding wheel (9) mounted freely rotatably on a support (10), means (11) for actuating the support, which are designed to displace the additional grinding wheel (9) between a retracted position and an active position in which its axis of rotation (Y—Y) is parallel to the axis of the said shaft and in which the additional grinding wheel is in driving contact with a drive disc (17) integral with the train of grinding wheels, and means for bringing the blank into contact with the additional grinding wheel (9) when the latter is in the active position. The invention is used for the counter-bevelling and/or grooving and/or drilling of optical glasses.

15 Claims, 7 Drawing Sheets

MACHINE FOR GRINDING OF OPTICAL GLASSES

BACKGROUND OF THE INVENTION

The present invention relates to a machine for the grinding of optical glasses, of the type comprising a main train of grinding wheels which is keyed on a shaft, and a blank-holding assembly designed to bring the blank into contact with the grinding wheels.

When an optical glass blank has been ground to the contour corresponding to the spectacle frame which will receive it, it must undergo, on each side, a counter-bevelling operation which breaks the two sharp edges of its contour. Moreover, when the frame comprises a glass-retaining wire on at least part of the periphery of each frame rim, a corresponding grooving that is to say a channel, has to be made on the edge or the blank.

SUMMARY

The object of the invention is to integrate on a grinding machine either and/or both of the abovementioned counter-bevelling and grooving operations economically and efficiently.

To achieve this, the subject of the invention is a grinding machine of the abovementioned type, characterized in that it comprises an additional grinding wheel mounted freely rotatably on a support, means for actuating the support, which are designed to displace the additional grinding wheel between a retracted position and an active position in which the axis of rotation of the additional grinding wheel is parallel to the axis of the said shaft and in which the additional grinding wheel is in driving contact with a drive disc integral with the train of grinding wheels, and means for bringing the blank into contact with the additional grinding wheel when the latter is in the active position.

BRIEF DESCRIPTION OF DRAWINGS

Exemplary embodiments of the invention will now be described with reference to the accompanying drawings in which.

DETAILED DESCRIPTION OF INVENTION

Figure 1:
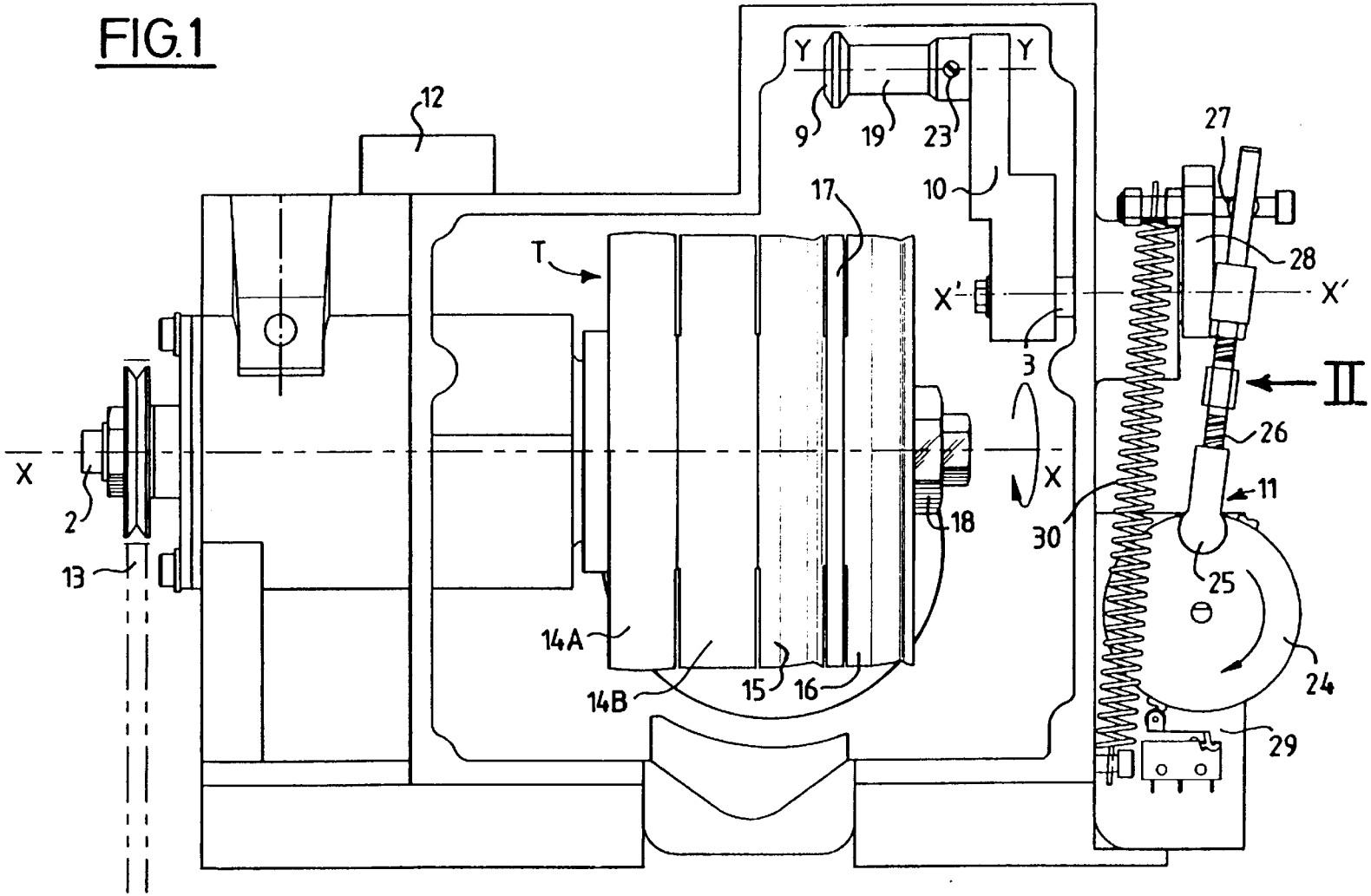
FIG. 1 is a partial top view of a grinding machine according to the invention along the line I—I of FIG. 2.
Figure 2:
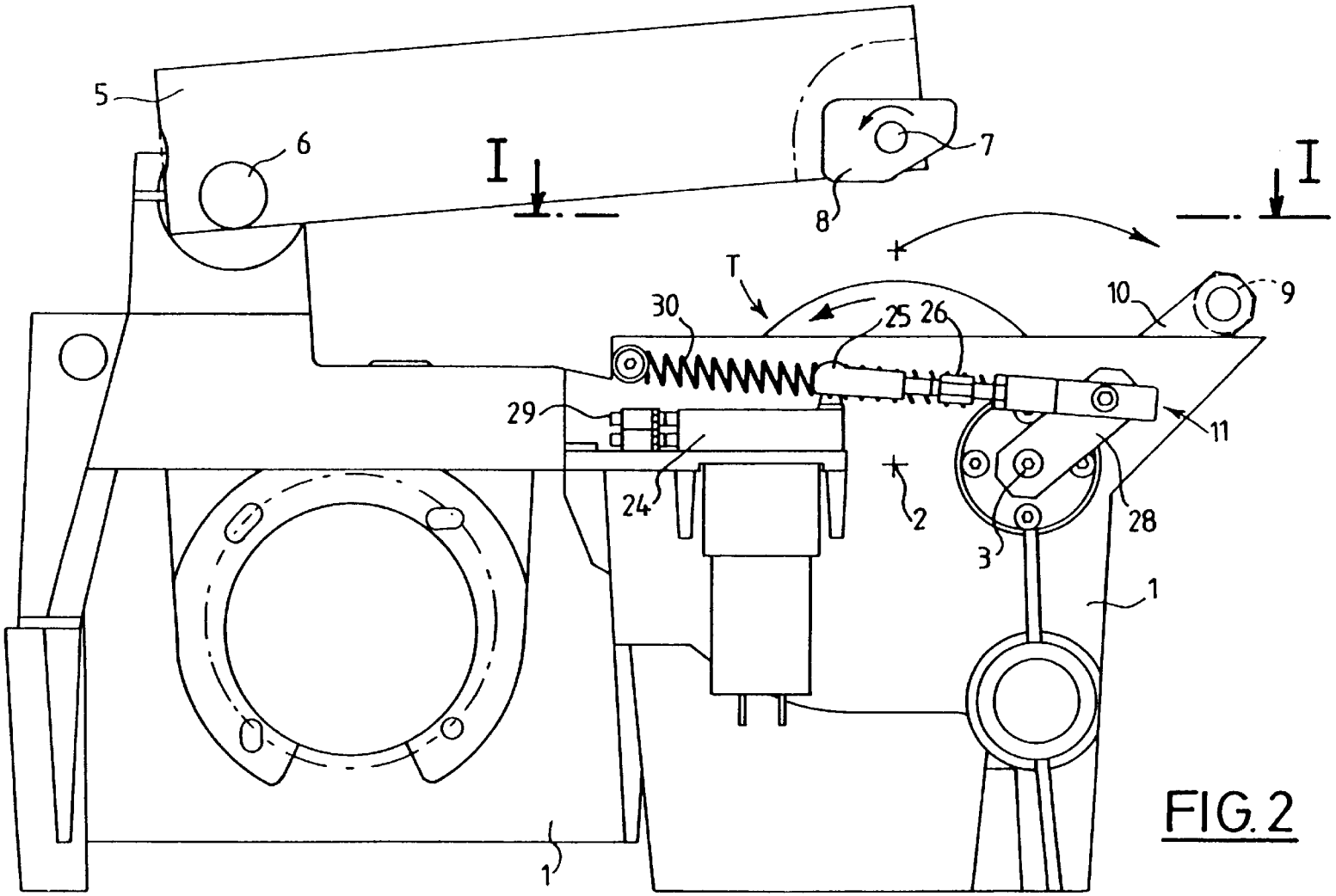
FIG. 2 is an end view of the machine, taken according to the arrow II of FIG. 1, with the additional grinding wheel in the retracted position.
Figure 3:
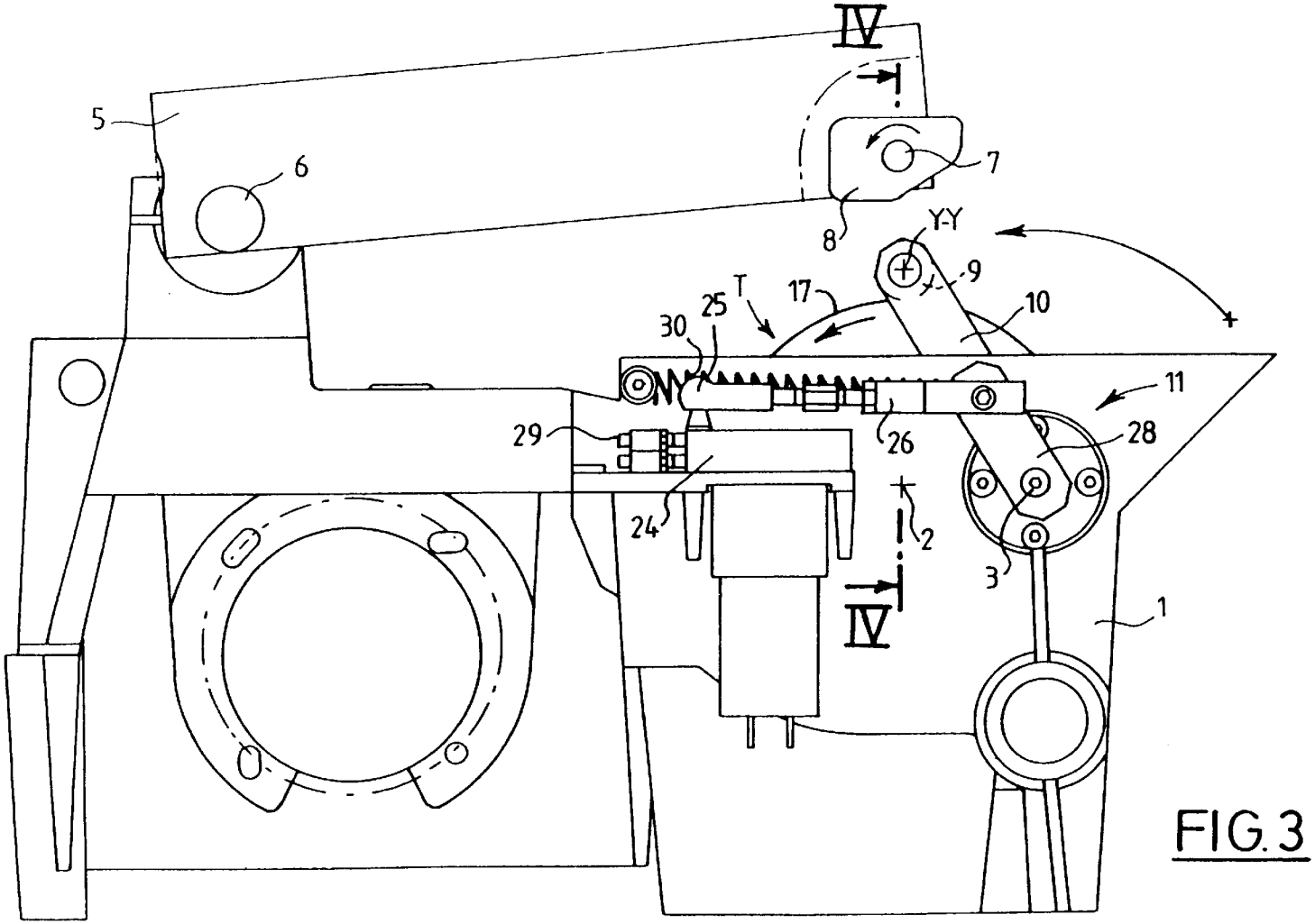
FIG. 3 is a view similar to that of FIG. 2, but with the additional grinding wheel in the active position.

The grinding machine illustrated in FIGS. 1 to 3 is intended for producing a bevelled and counter-bevelled optical glass from a generally circular blank. It comprises essentially a stand 1, in which are mounted rotatably two parallel shafts, namely a wheel-holding shaft 2 of axis X—X and an arm-holding shaft 3 of axis X'—X'. The axes X—X and X'—X' are horizontal. Moreover, a carriage 5 is mounted on the stand 1 so as to be slidable parallel to the two shafts. Furthermore, this carriage is mounted tiltably on the stand and, for this purpose, it is articulated along one longitudinal edge about a shaft 6 parallel to the shafts 2 and 3. Along its other longitudinal edge, the carriage 5 carries two half-shafts 7 designed for gripping the blank which is shown being ground at 8 in FIG. 2. The machine also comprises an additional grinding wheel 9 made of diamond-charged sintered metal and mounted freely rotatably at the end of an arm 10 fastened to the shaft 3. The tilting of the arm 10 is controlled by a mechanism 11 of the connecting-rod/crank type.

The machine also comprises an electronic control unit 12 with a programming keyboard, said unit being indicated diagrammatically in FIG. 1. This unit is designed to execute the commands, which will be described later, in order to perform a completely automated cycle of the machining of the optical glass.

The wheel-holding shaft 2 is driven in rotation about the axis X—X by an electric motor, not shown in the drawings, via a transmission belt 13. Keyed on this shaft is a plurality of juxtaposed grinding wheels forming a main train of grinding wheels T, including a wheel 14A for the rough-cutting of mineral glasses, a wheel 14B for the rough-cutting of synthetic glasses, a finishing wheel 15 (for plate-glass grinding or bevelling) and a polishing wheel 16. The wheel 16 has the same profile as the wheel 15, but with a finer grain. Keyed between these last two grinding wheels is a friction disc 17 having a cylindrical peripheral surface consisting of a plastic or elastomeric covering. The stack 14A, 14B, 15, 16 is secured in place by means of fastening members 18 screwed at the shaft end.

The arm 10 forms a crank, the crankpin 19 of which has an axis Y—Y parallel to the axes X—X and X'—X' and carries the freely rotating grinding wheel 9 at its free end.

This grinding wheel 9, having a much smaller diameter than that of the grinding wheels 14A to 16, possesses externally (FIG. 4) a cylindrical median surface 20 framed by two frustoconical surfaces which converge away from this surface 20. These are a surface 21 having a relatively small half-angle at the apex, for example of the order of 45°, and an opposite surface 22 having a relatively large half-angle at the apex, for example 60°.

The axial position of the grinding wheel 9 along the axis Y—Y is adjustable and may be blocked by means of a radial screw 23. Adjustment is such that the mid-plane of the cylindrical surface 20 of the grinding wheel 9 is in the vicinity of that of the friction disc 17.

The mechanism 11 comprises a motorized disc 24 of vertical axis, on the periphery of which a connecting rod 26 of adjustable length is articulated by means of a ball joint 25. The connecting rod 26 is connected at its other end, by means of a second ball joint 27, to the end of a crank 28 which is keyed on the shaft 3. FIGS. 1 to 3 also illustrate a limit switch 29 cooperating with the periphery of the disc 24, as well as a helical draw spring 30 which permanently stresses the crank 28 and therefore the arm 10 in the direction of the axis X—X.

The electronic control unit 12 contains in its memory the data relating to the spectacle frame to be equipped and to the patient's morphology. On the basis 15 of these data, it controls the translational movement and angular position in the carriage 5 as a function of the angular position of the blank 8 on the half-shafts 7, during the operations of grinding, finishing/polishing and counter-bevelling the blank, in the way described below.

At the outset (FIGS. 1 and 2), the arm 10 is tilted outwards relative to the train of grinding wheels T and completely frees the space located above these wheels. As is known, the blank is keyed between the half-shafts 7 by means of a suitably centred adapter and is then brought successively onto the grinding wheels 14A or 14B, 15 and, if appropriate, 16.

Figure 4:
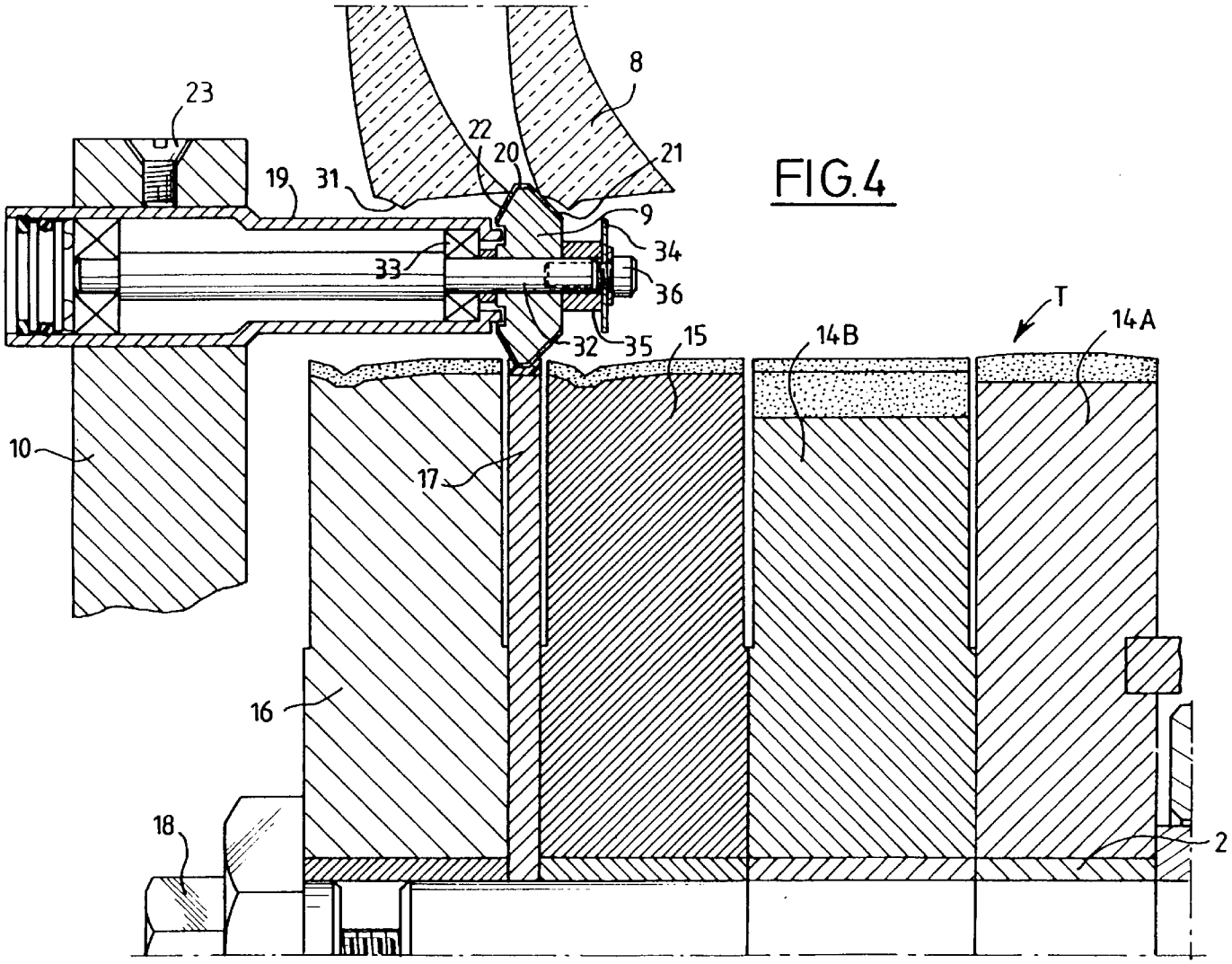
FIG. 4 is a partial sectional view along the line IV—IV of FIG. 3, but on a larger scale, illustrating the functioning of the additional grinding wheel.

The blank then has its final contour and possesses on its edge a bevel 31 which may be seen in FIG. 4.

With the bracket 5 being raised, the unit 12 causes the disc 24 to rotate and consequently the arm 10 to tilt towards the axis X—X. This movement brings the cylindrical surface 20 of the grinding wheel 9 into 35 contact with the disc 17, so that this wheel is driven in rotation at high speed about its axis Y—Y which is parallel to the axes X—X and X'—X'.

Under the command of the unit 12, the translational movement of the carriage 4 and the inclination of the bracket 5 are controlled in such a way as to bring one edge of the contour of the blank onto the frustoconical surface 21 of the grinding wheel 9 in the course of at least one revolution of the blank on itself and then to bring the other edge of the contour of the blank onto the other frustoconical surface 22. In this way, the two counter-bevels of the glass are produced, without displacing the blank, without additional apparatus and without the operator being involved, other than to program this operation on the control keyboard of the machine.

It should be noted that the greatest inclination of the surface 21 relative to the surface 22 with respect to the radial direction makes it possible to produce the counter-bevel on the convex side of the glass, as illustrated in FIG. 4.

FIG. 4 also shows a possible variant of the machine, according to which the hub 32 of the grinding wheel 9, the said hub being mounted rotatably in the crankpin 19 of the arm 10 by means of a bearing 33, is extended beyond the grinding wheel 9. Keyed on this extension is a grooving disc 34 having a diameter clearly smaller than that of the grinding wheel 9 and held at a predetermined distance from the latter by means of a spacer. 35, the assembly as a whole being secured in position by an end screw 36.

Thus, when the counter-bevel is produced, or even before this operation, the blank can be brought into line with the grooving wheel 34 in order to hollow out on its edge a channel which extends over a predetermined part of the periphery of the glass.

Figure 5:
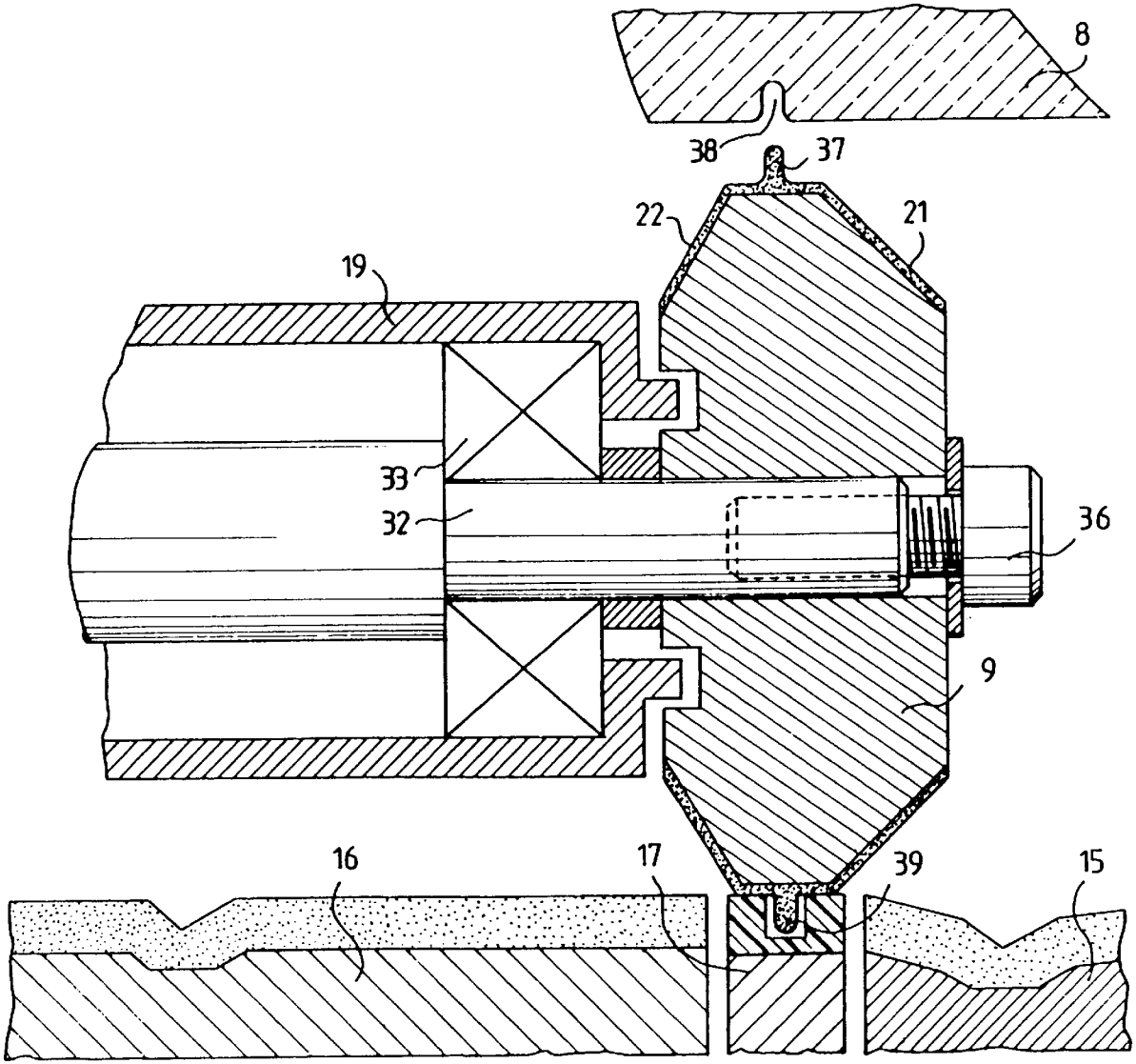
FIG. 5 is a view similar to that of FIG. 4, but on an even larger scale, illustrating a variant.

Alternatively, as illustrated in FIG. 5, the grinding wheel 9 may be modified in order likewise to form a grooving wheel. For this purpose, a radial projection 37 is provided on the cylindrical surface 20, the profile of the said projection being matched to that of the grooving channel 38 to be produced.

In the event that, according to FIG. 4 or FIG. 5, the arm 10 carries a grooving wheel, the translational movement of the carriage 4 is controlled, during the grooving operation, in such a way as to position the channel 38 on the edge of the glass in the intended way, for example at e/3 of the front face, where e designates the thickness of the edge of the glass.

When the grinding wheel 9 is equipped with the projection 37, as in the variant of FIG. 5, a channel 39 designed to receive this projection is provided in the friction disc 17, as illustrated.

Figure 6:
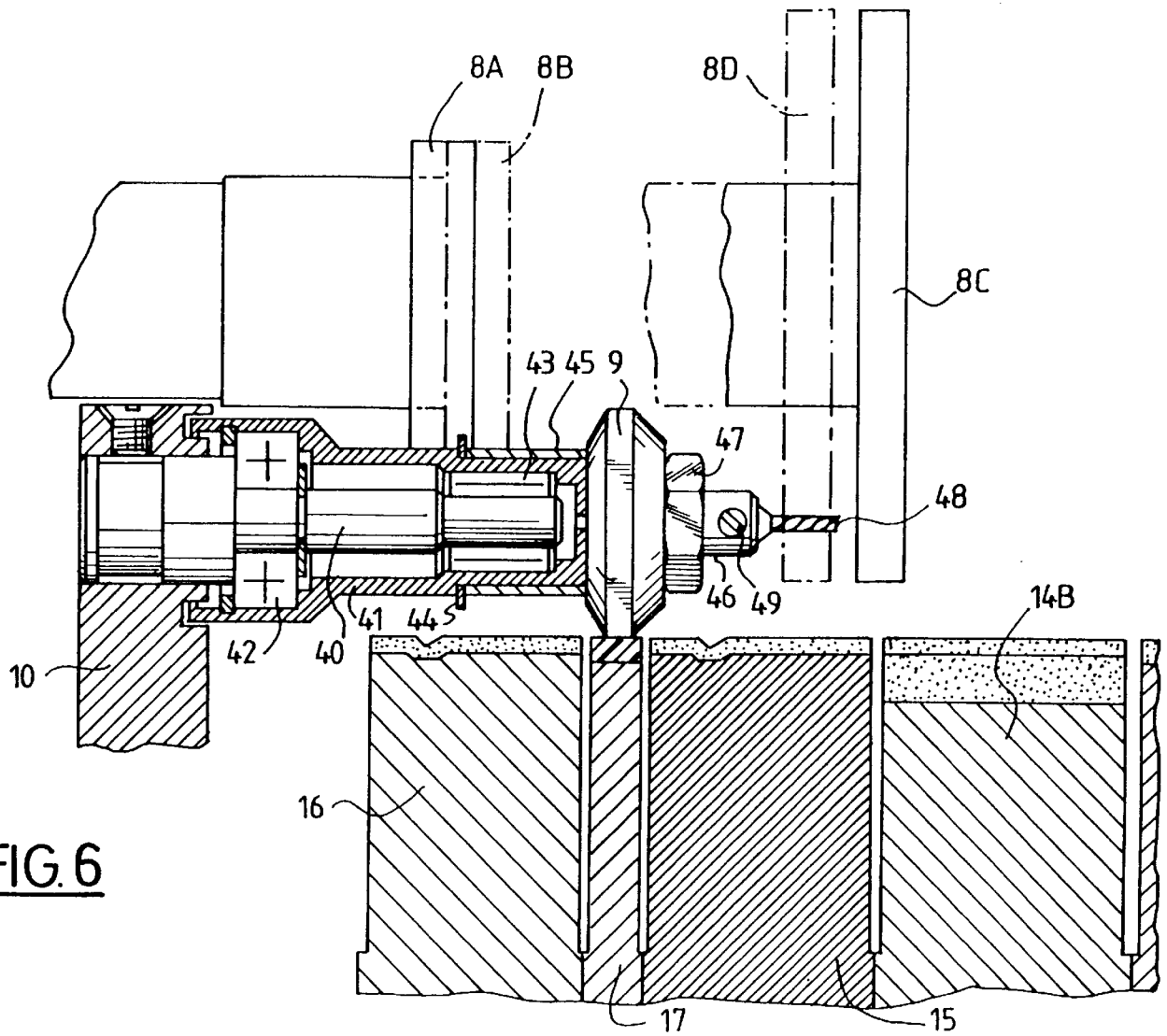
FIG. 6 is a view similar to that of FIG. 4, illustrating another variant.

In the variant of FIG. 6, the arm 10 is equipped with a freely rotatable assembly having the triple function of counter-bevelling, grooving and drilling.

Thus, the end of the arm 10 carries a male crankpin 40, on which a sleeve 41 is mounted rotatably by means of two rolling bearings 42 and 43. The end of this sleeve opposite the arm 10 comprises an outer spot facing, on which is slipped a grooving ring 44 held by a collar 45.

The sleeve 41 is extended by a shaft end 46, on which the counter-bevelling wheel 9 is slipped. A nut 47 screwed onto the threaded end of the shaft end 36 presses axially the assembly consisting of the wheel 9, collar 45 and ring 44.

Moreover, the base of a drill bit 48 is introduced into an axial duct of the shaft end 46 and is secured in place by means of a radial screw 49.

Thus, the blank 8 can be brought into the selected grooving position by controlling the axial position of the carriage 5. Two different positions are illustrated in FIG. 6, one 8A by unbroken lines and the other 8B by dot-and-dash lines.

It should be noted that the position of the ring 44 set back relative to the grinding wheel 9 makes it possible to reduce the bulk of the finishing device carried by the arm 10.

The blank 8 may likewise be counter-bevelled, as described above, or else drilled. For this purpose, it is brought in front of the bit 48 into the desired angular position, as indicated by a dot-and-dash line at 8C, then the carriage is displaced towards the bit and the blank is perforated by the latter. Displacement of the carriage is terminated when the bit has emerged slightly from the blank, the latter then being in the position 8D indicated by dot-and-dash lines.

So that not only circular holes, but also oblong slots can be drilled, the bit 48 is preferably an end and face milling cutter. Thus, after a hole has been drilled, the blank can be displaced in its general plane in order to produce the oblong slot.

For each of the counter-bevelling and grooving operations, the accurate control of the position of the carriage for each angular position of the blank can be obtained from two tracers brought respectively into contact with the two faces of the glass. These tracers record the profiles of these two faces, and the control unit 12 deduces the control of the carriage therefrom.

For example, unit 12 contains a series of predetermined paths in its memory and selects from these a path which is inscribed between the two profiles recorded by the tracers, as described in FR-A-2,499,442.

In another embodiment, the carriage may be controlled as the result of a law of calculation applied to the two recorded profiles. For example, grooving may be carried out at e/3 from the front face, where e designates the thickness of the glass on its periphery.

The position of the carriage and its travel in the drilling operation may likewise be determined from the tracing of the two faces of the blank in its angular drilling position and from a pre-established law of calculation. The travel during drilling may thus be equal to $e+\epsilon$, $\epsilon$ being the distance over which the bit emerges after drilling (for example, $\epsilon$=0.5 to 1 mm), and the travel being calculated from bit/blank contact. Such contact may be obtained, in a way known per se in numerically controlled machine tools, by means of a procedure known as "zero offset", that is to say setting the carriage in relation to an adjusting template.

By means of the control described above, the active length L of the bit 48, which is a part of very small diameter (typically 1 mm) engaging curved surfaces, may be limited to $E+\epsilon$, where E designates the greatest glass thickness which is to be drilled. For example, L=approximately 5 mm may be selected.

Figure 7:
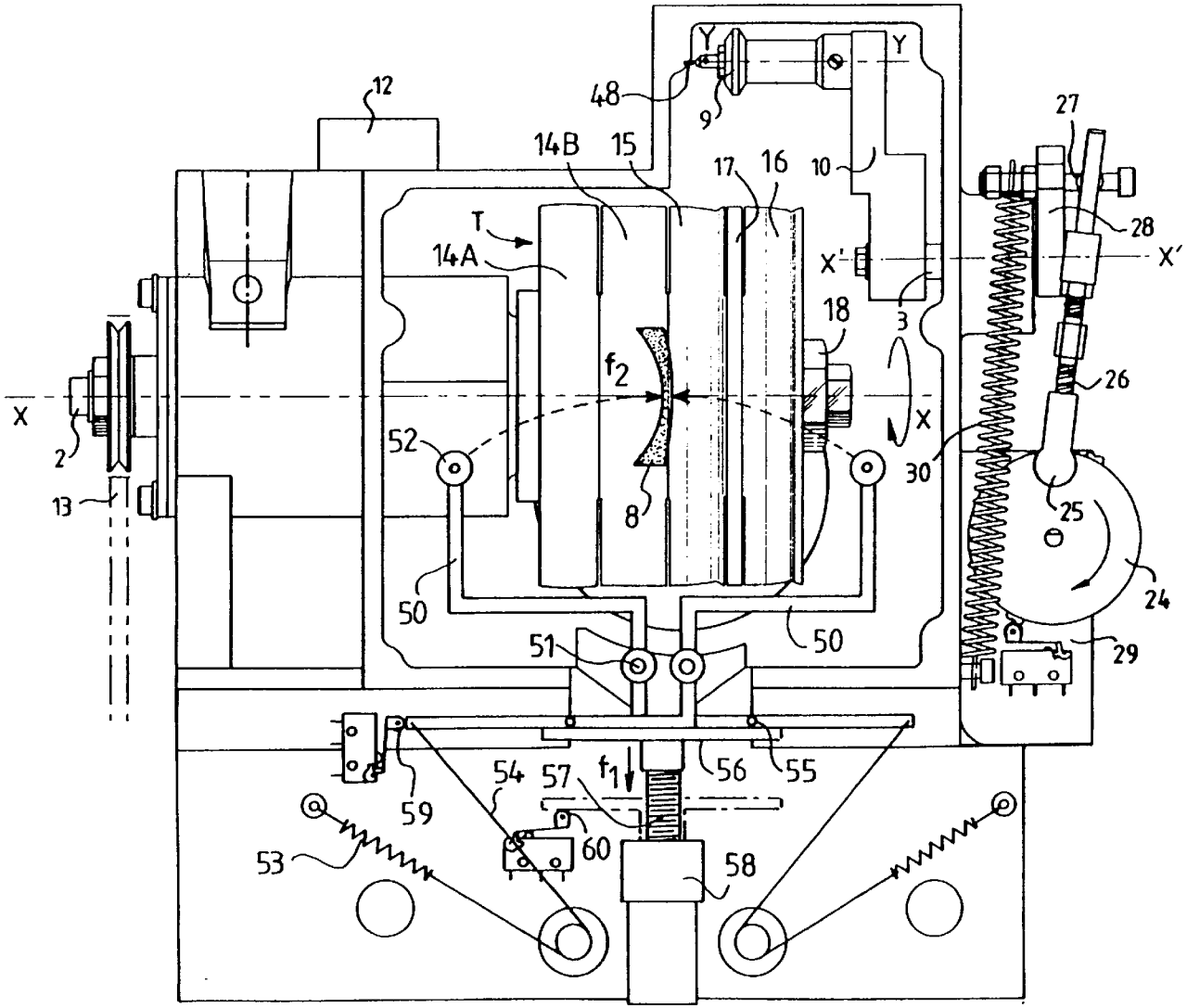
FIG. 7 is a view similar to that of FIG. 1, corresponding to the variant of FIG. 6.

FIG. 7 illustrates diagrammatically, in a similar way to FIG. 1, an arrangement with two tracers which is designed for implementing the variant in FIG. 6.

For this purpose, the machine has had added to it two S-shaped levers 50 articulated on two parallel vertical axes 51 integral with the stand of the machine. Each lever carries, at its free end, a roller 52 likewise having a vertical axis and forming a tracer. The other end of each arm is stressed by a spring 53 via a cable 54 in the direction which separates the two tracers from one another. This movement is limited by the coming of a vertical pin 55 carried by each arm into abutment against a control plate 56.

The plate 56 carries a horizontal threaded rod 57 actuated by a geared motor. In the illustrated extended position of the rod 57, the plate 56 holds the two tracers in the position of maximum separation. When the rod 57 is retracted (arrow f1) , the arms 50 are released, so that the springs 53 bring the two tracers closer to one another (arrows f2), until they come into contact with the blank 8 previously positioned axially and angularly in a predetermined way. Thus, via the unit 12, the angular displacement of the two arms 50 supplies the thickness e of the blank at the location of the drilling to be carried out.

FIG. 7 likewise indicates diagrammatically limit switches 59 (tracers fully separated) and 60 (rod 57 fully retracted).

For a counter-bevelling or grooving operation, it is possible, by means of the two tracers, to conduct a series of double front-face/rear-face tracings of the blank in a particular number of predetermined angular positions of the latter, and to deduce therefrom the axial displacement of the carriage 5 as a function of the angular position of the blank during counter-bevelling or grooving.

We claim:

1. Machine for the grinding of optical glasses, comprising a shaft, a main train of grinding wheels (T) keyed on said shaft (2), a drive disc fixed for rotation with the main train of grinding wheels, a blank-holding assembly (5, 7) designed to bring a blank (8) into contact with the grinding wheels, a first additional grinding wheel (9) mounted freely rotatably on a support (10, 19), means (11) for actuating the support to displace the first additional grinding wheel (9) between a retracted position and an active position in which an axis of rotation (Y—Y) of the first additional grinding wheel is parallel to an axis (X—X) of said shaft and in which the first additional grinding wheel is in driving contact with said drive disc (17), and means (12) for bringing the blank into contact with the first additional grinding wheel (9) when the first additional grinding wheel is in the active position.

2. Machine according to claim 1, characterized in that the additional grinding wheel (9) has an outside diameter smaller than that of the grinding wheels (14A, 14B, 15, 16) of the train of grinding wheels (T).

3. Machine according to claim 1, characterized in that the drive disc (17) is an additional disc which has an outer surface made of friction material and which is stacked with grinding wheels (14A, 14B, 15, 16) of the train of grinding wheels (T).

4. Machine according to claim 1, characterized in that the friction material is a plastic or an elastomeric material.

5. Machine according to claim 1, characterized in that the support (10, 19) comprises a crank arm (1) mounted rotatably on an axis (X'—X') parallel to the axis (X—X) of said shaft (2).

6. Machine according to claim 1, characterized in that the first additional grinding wheel (9) is a counter-bevelling wheel which has two opposite active faces (21, 22) of general frustoconical shape.

7. Machine according to claim 6, characterized in that the two active faces (21, 22) have different angles at an apex.

8. Machine according to claim 6, characterized in that the first additional grinding wheel (9) has a radial grooving projection (37) between the two opposite faces (21, 22).

9. Machine according to claim 8, characterized in that the drive disc (17) comprises a peripheral channel (39) designed to receive the radial projection (37).

10. Machine according to claim 6, characterized in that the support (10, 19) carries, furthermore, a grooving wheel and is spaced axially from and is fixed for rotation with the first additional grinding wheel (9) and an outer radius of which is smaller than that of the first additional grinding wheel.

11. Machine according to claim 10, characterized in that the second additional grinding wheel (43) is arranged so as to be set back relative to the counter-bevelling wheel (9).

12. Machine according to claim 1, characterized in that the support (10, 19) carries, furthermore, a drilling tool (47) coaxial to the first additional grinding wheel (9) and fixed for rotation with the first additional grinding wheel.

13. Machine according to claim 12, characterized in that the drilling tool (47) is a milling cutter designed to produce oblong slots.

14. Machine according to claim 1, further comprising means (50 to 54) for tracing two faces of the blank and command means (12) for controlling displacements of the blank-holding assembly (5, 7) as a function of tracing indications.

15. Machine according to claim 14, characterized in that the support (10, 19) carries, furthermore, a drilling tool (47) coaxial to the first additional grinding wheel (9) and fixed for rotation with the first additional grinding wheel and in that the command means (12) is designed to calculate drilling travel as a function of the thickness of the blank (8) resulting from the tracing indications.

* * * * *